US007817118B2

(12) United States Patent
Kawabe

(10) Patent No.: US 7,817,118 B2
(45) Date of Patent: Oct. 19, 2010

(54) DISPLAY DEVICE

(75) Inventor: Kazuyoshi Kawabe, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 681 days.

(21) Appl. No.: 11/696,304

(22) Filed: Apr. 4, 2007

(65) Prior Publication Data

US 2007/0242002 A1 Oct. 18, 2007

(30) Foreign Application Priority Data

Apr. 17, 2006 (JP) ..... 2006-113367

(51) Int. Cl.
*G09G 3/30* (2006.01)

(52) U.S. Cl. ..... 345/76; 345/72; 345/83

(58) Field of Classification Search ..... 345/55–102
See application file for complete search history.

(56) References Cited

U.S. PATENT DOCUMENTS 6,424,326 B2 * 7/2002 Yamazaki et al. ..... 345/77

2004/0174323 A1 * 9/2004 Yamashita et al. ..... 345/75.2

FOREIGN PATENT DOCUMENTS

WO 2005/116971 12/2005
WO 2006/020511 2/2006

* cited by examiner

*Primary Examiner*—David L Lewis
(74) *Attorney, Agent, or Firm*—Morgan Lewis & Bockius LLP

(57) ABSTRACT

A display device in which measurement emissive elements that emit light in accordance with a drive current are arranged in a matrix within a display region, the display device includes a measurement emissive element which is formed in a position different from the display region and formed by the same process as the organic EL elements formed in the display region; drive voltage supply circuit for supplying drive voltage to the measurement emissive element; and drive state detection circuit for detecting the drive state of the measurement emissive element in the case where the drive voltage is supplied by the drive voltage supply circuit.

12 Claims, 4 Drawing Sheets

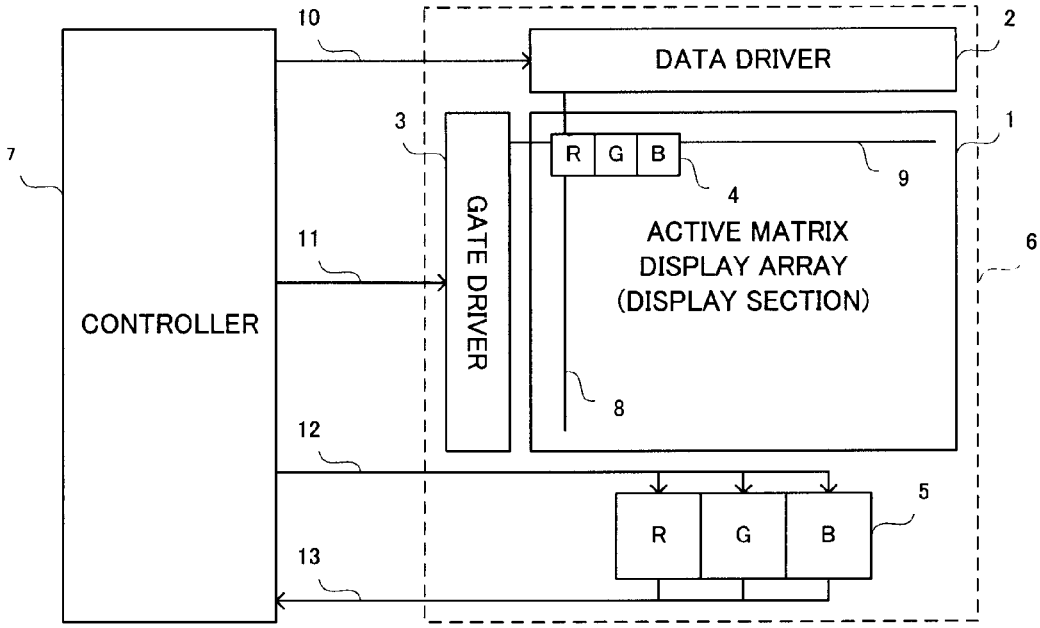
Fig. 1
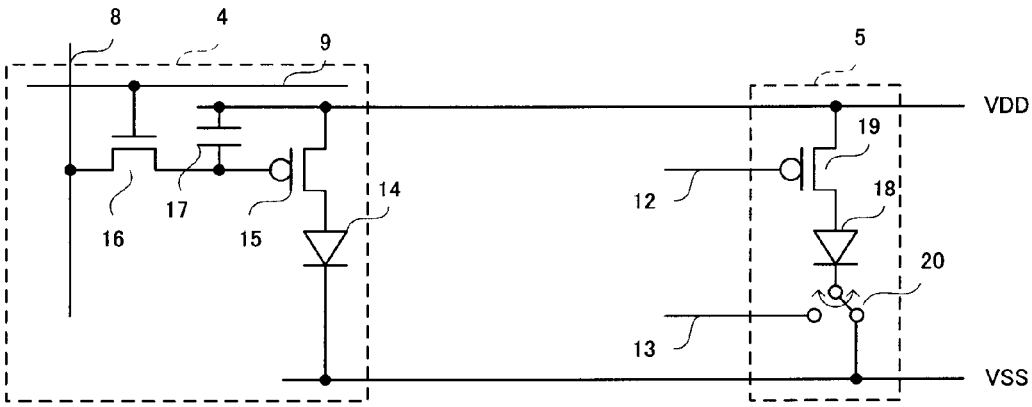
Fig. 2A
Fig. 2B

DISPLAY DEVICE

CROSS-REFERENCE TO RELATED APPLICATION

This application claims priority to Japanese Patent Application No. 2006-113367 filed Apr. 17, 2006 which is incorporated herein by reference in its entirety.

FIELD OF THE INVENTION

The present invention relates to a display device in which self-emissive elements that emit light in accordance with a drive current are arranged in a matrix within a display region.

BACKGROUND OF THE INVENTION

An organic EL (Electro Luminescence) display has drawn attention as a display of the next generation because of its self-emission, fast response, brightness and wide viewing angle. Among other things, an active matrix organic EL display is applicable for various purposes from a cell phone to a large-sized TV set because it can be manufactured in higher definition, and there are great expectations for the organic EL display.

Organic EL elements that form pixels need drive elements for controlling a current flown in the organic EL elements in order to control emission. A TFT (Thin Film Transistor), for example, is used as the drive element, and a low-temperature polysilicon TFT in particular is considered to be appropriate as the drive element for driving the organic EL elements since it has relatively high mobility, is operable at high-speed, and is stable for a relatively long time.

As described, although the low-temperature polysilicon TFT is stable and has high mobility, uneven luminance easily occurs when it is used in a saturated region because its characteristics are not uniform. Herein, uniformity can be improved when the TFT is used as a switch and a digital drive, which generates gradation depending on whether or not voltage is applied to the organic EL elements, is used.

However, in this case, since the organic EL elements are controlled depending on whether or not voltage is applied, it has a drawback that burn-in tends to appear on a display due to the degradation of organic EL elements associated with a long-time operation, that is, they become highly resistive.

Further, since the current-voltage characteristics of the organic EL elements changes when the ambient temperature changes, a larger amount of current flows when the temperature rises, for example, even if the same voltage is applied. If the amount is different for red (R), green (G) and blue (B) in the case of full-color display, white balance becomes off-balance and there is a problem that the original color cannot be expressed.

SUMMARY OF THE INVENTION

The present invention relates to a display device in which self-emissive elements that emit light in accordance with a drive current are arranged in a matrix within a display region, which includes: a self-emissive element for measurement purposes, which is formed in a position different from the display region and formed by the same process as the organic EL elements formed in the display region; drive voltage supply circuit for supplying drive voltage to the self-emissive element for measurement purposes; and drive state detection circuit for detecting the drive state of the self-emissive element for measurement purposes in the case where the drive voltage is supplied by the drive voltage supply circuit.

Further, it is desirable for the drive state detection circuit to detect the drive current flowing in the self-emissive element for measurement purposes.

Further, the drive state detection circuit can also detect the emission amount of the self-emissive element for measurement purposes.

Furthermore, the display device can include: correction circuit for correcting voltage to be applied to each self-emissive element in the display region based on the drive state detected by the drive state detection circuit.

Furthermore, the drive voltage supplied to the self-emissive elements in the display region to be a specified voltage and for the drive of the self-emissive elements in the display region to be digital drive where drive voltage to be supplied to the self-emissive elements is a predetermined voltage and the supply time of the drive voltage is controllable, and the correction circuit changes positive or negative power supply voltage of the self-emissive elements in the display region.

Further, the drive voltage supply circuit can supply drive voltage, which represents the drive voltage to be supplied to the self-emissive elements in the display region, to the self-emissive element for measurement purposes.

Furthermore, the drive voltage to be supplied to the self-emissive elements in the display region can be a specified voltage and for the drive of the self-emissive elements in the display region to be digital drive where drive voltage to be supplied to the self-emissive elements is a predetermined voltage and the supply time of the drive voltage is controllable, and the drive voltage supply circuit supplies a typical pulsed voltage, which digitally drives the self-emissive elements in the display region, to the self-emissive element for measurement purposes.

Furthermore, the self-emissive elements in the display region and the self-emissive elements for measurement purposes can have three colors of red (R), green (G) and blue (B), and for the display device to have display data set circuit that calculates the maximum luminance of each color of RGB from the drive state of the self-emissive element for measurement purposes of each color of RGB, which is detected by the drive state detect circuit, in the drive state detect circuit, and sets display data within a range where the white display is executable.

BRIEF DESCRIPTION OF THE DRAWINGS

FIG. 1 is a view showing the overall configuration of the display device according to the present invention.

FIGS. 2A and 2B are views showing the configuration of a pixel in a display region and a pixel for measurement purpose.

DETAILED DESCRIPTION OF THE INVENTION

Figure 3C:
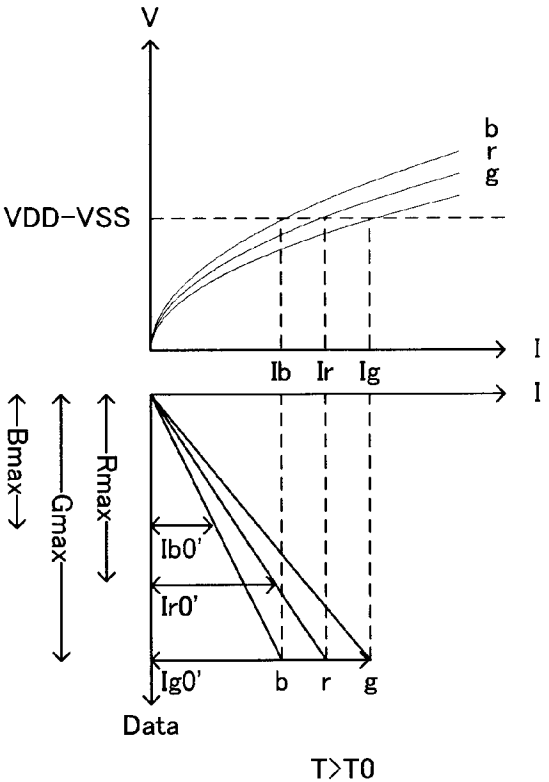
FIGS. 3A, 3B and 3C are graphs showing the display characteristics of each color of RGB.

FIG. 1 is the entire arrangement of the display device according to one embodiment of the present invention. A display panel 6 has an active matrix display array (display section) 1 in which display pixels 4 having organic EL elements are arranged in a matrix. Further, the display panel 6 is provided with a data driver 2 for supplying display data to each display pixel 4 and a gate driver 3 for controlling the capture of the display data in each display pixel 4, and is also provided with a measurement pixel 5 separated from the display pixels 4. Note that the display panel is formed on one glass substrate, for example. Further, the display pixels 4 and the measurement pixel 5 consist of three display dots of RGB in the case of full-color display.

In this example, data lines 8 are extended along each column of the display pixels 4 (each column of display dots in this example) from the data driver 2, and gate lines 9 are extended along each row of the display pixels 4 from the gate driver 3. Then, the display pixels 4 are selected by the gate driver 3 via the gate lines 9, and display data supplied from the data driver 2 is written via the data lines 8.

Further, a controller 7 is provided separately from the display panel 6, and the controller 7 supplies a signal from outside to the data driver 2 and the gate driver 3 after converting the signal into a signal suitable for operating the display panel, and supplies a control signal to the measurement pixel 5 via a control line 12.

Furthermore, current flowing in the measurement pixel 5 is led to the controller 7 via a current line 13, and the controller 7 reads its current value.

FIG. 2A is an equivalent circuit diagram of a display dot of any color of RGB of the display pixel 4, and FIG. 2B is an equivalent circuit diagram of a display dot of any color of RGB of the measurement pixel 5.

The display pixel 4 is made up of an n-channel selective transistor 16 whose source or drain is connected to the data line 8 and gate is connected to the gate line 9, a holding capacitor 17 whose one end is connected to the drain or source of the selective transistor 16 and other end is connected to a power source line VDD, a p-channel drive transistor 15 whose gate is connected to the drain or source of the selective transistor 16 and to one end of the holding capacitor 17 and source is connected to the power source line VDD, and an organic EL element 14 whose anode is connected to the drain of the drive transistor 15 and cathode is connected to a power source line VSS.

The measurement pixel 5 is made up of a drive transistor 19 whose source is connected to the power source line VDD and gate is connected to the control line 12, an organic EL element 18 whose anode is connected to the drain of the drive transistor 19, and a switch 20 that connects the cathode of the organic EL element 18 either to the power source line VSS or the current line 13 in a switching manner. The switch 20 should be manufactured by a TFT, but it may be manufactured by other components.

Although the emission areas of the organic EL element 14 in the display pixel 4 and the organic EL element 18 in the measurement pixel 5 are not necessarily the same, they are elements formed by the same organic EL manufacturing process and their various characteristics such as current-voltage characteristics and color characteristics are equal.

The current flowing to the organic EL element 14 for display purposes is controlled by turning the drive transistor 15 on/off. The selective transistor 16 leads the display data, which was supplied to the data line 8, to the holding capacitor 17, current flows to the organic EL element 14 if the display data has a sufficient voltage level for turning the drive transistor 15 on, and no current flows to the organic EL element 14 if it has a sufficient voltage level for turning the drive transistor 15 off. The intensity of emission is controlled by this on/off period, and current continues to flow in the organic EL element 14 during the on period due to the constant voltage.

On the other hand, the emission intensity of the organic EL element 18 for measurement purposes is controlled by voltage supplied to the control line 12 on the same principle. Further, the switch 20 connects the cathode of the organic EL element 18 either to the power source line VSS or the current line 13.

Furthermore, the power source lines VDD and VSS are commonly used among the display pixel 4 and the measurement pixel 5, and the voltage of VDD-VSS is applied to both the organic EL element 14 for display purposes and organic EL element 18 for measurement purposes when the drive transistors (15, 19) are turned on.

Next, description will be given for the operation of the display pixel 4 and the measurement pixel 5 which are operated by digital drive. The method disclosed in WO 2005/116971, for example, can be applied as a control method of emission intensity using a digital drive method.

In this case, data corresponding to each sub-frame (voltage at which the drive transistor 15 is turned on and turned off) is written in the display pixel 4. Since the constant voltage of VDD-VSS is applied to the organic EL element 14 during emission, a larger amount of current is caused to flow in the organic EL element 14 by the same voltage when the temperature rises, for example, and the entire screen becomes brighter. Since the screen becomes darker in the opposite case, desired display cannot be performed. FIG. 3 shows such a state.

Figure 3B:
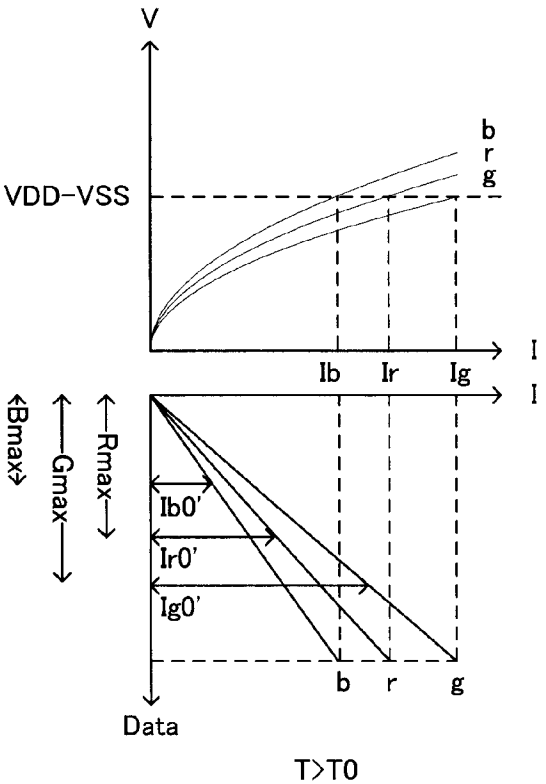
Figure 3A:
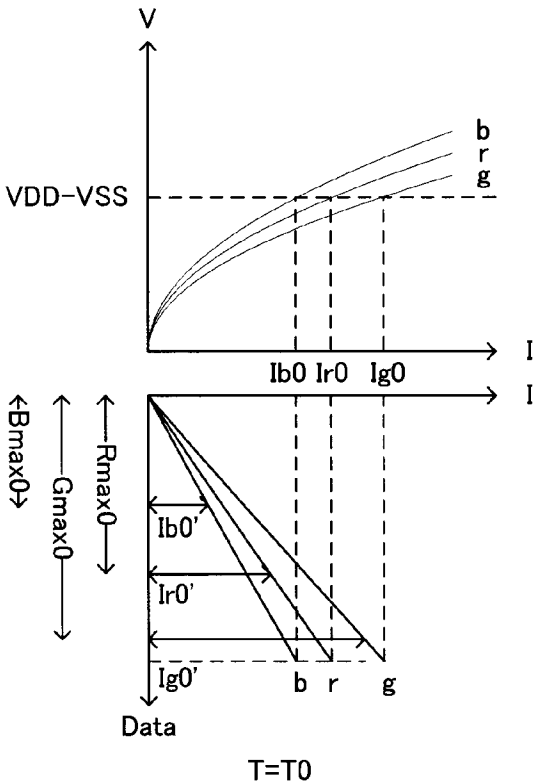

Assuming that the organic EL elements (14, 18) of RGB indicate the voltage-current characteristics as shown in FIG. 3A at temperature T0, the organic EL elements of RGB respectively indicate current Ir0, Ig0 and Ib0. Therefore, each pixel of RGB has a maximum current of Ir0, Ig0 and Ib0, and the digital drive realizes multiple gradation by controlling an emission period within this region. Generally, characteristics of organic EL elements such as color and emission efficiency fluctuate within a certain range due to a manufacturing problem, so that appropriate white balance cannot be maintained when the maximum current values are given as the maximum gradations. FIG. 3A is an example in which the maximum current, which is originally Ir0, Ig0 and Ib0, is limited to Ir0', Ig0' and Ib0' in order to maintain appropriate white balance and data corresponding to the current is re-allocated to the maximum gradation data Rmax0, Gmax0 and Bmax0. If the digital drive can generate sufficient gradation of 8 bits or more, for example, it can generate sufficient gradation even after conversion, so that appropriate white balance can always be maintained even if the characteristics of the organic EL elements fluctuate. In the case where the characteristic fluctuation amount of the organic EL elements is known in advance, it is desirable for the emission area of each color of RGB to be made different from each other to maintain sufficient gradation display while the white balance be adjustable.

Herein, assuming that the temperature rises to temperature T (>T0), for example, the current in the organic EL element of each color of RGB changes in accordance with its inherent characteristics. FIG. 3B is an example in which the voltage VDD-VSS applied to the organic EL elements is set to the same level as the case of the temperature T0. Assuming that each current is Ir, Ig and Ib, these values become the maximum current of each color of RGB at temperature T. Even in the case where the temperature reaches T(>T0), the appropriate white balance cannot be maintained if the same display data as in the case of temperature T0 is continuously input, resulting in an image having different color tint and brightness. Thus, in FIG. 3B, the limited maximum current values Ir0', Ig0' and Ib0' is maintained at which the same white balance as the case of temperature T0 is generated, and the limited maximum gradation is converted into Rmax, Gmax and Bmax which are different from the case of temperature T0. Although current rise associated with the temperature rise is adjusted by reducing the display data in the case of FIG. 3B, a gradation reproduction range becomes narrower when the display data gets smaller. Thus, since the limited maximum gradation (Rmax, Gmax and Bmax) can be brought to original maximum values when the voltage VDD-VSS to be applied to the organic EL elements is made smaller and the display data is adjusted, the gradation reproduction range can be made larger while maintaining the appropriate white balance, which is effective.

Further, the method of FIG. 3C can also be applied for the purpose of correcting luminance reduction due to the deterioration over time of the emission efficiency and current of organic EL elements.

Figure 4A:
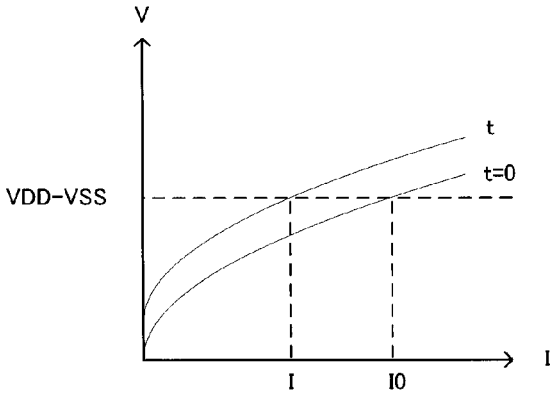
FIGS. 4A and 4B are graphs showing drive current variations due to power source voltage variations.
Figure 4B:
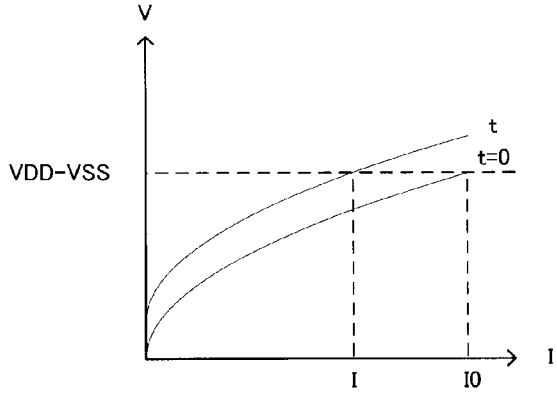

As shown in FIG. 4A, the voltage-current characteristics of the organic EL elements deteriorate with time when current is made to flow continuously, and current I at time t is reduced from current I0 at time t=0 for the same applied voltage. As shown in FIG. 4B, if the applied voltage is set higher and current can be controlled such that a larger amount of current is made to flow in the deteriorated organic EL elements, current deterioration can be corrected. It is to be noted that, as long as normal images are displayed, pixels that are constantly turned on and pixels that are rarely turned on exist on the same panel and the progress of deterioration is different among pixels, so that current of a predetermined value or more is made to flow in pixels having small rate of deterioration if the applied voltage is increased as in FIG. 4B. However, since allowing high current to flow in pixels having lower rate of deterioration accelerates deterioration, uniformity of deterioration is expected.

Next, description will be given for a control method of maintaining the white balance and correcting the current deterioration of organic EL elements.

The operation of the measurement pixel 5 will be described first. During normal display, images are displayed on the display section 1 and a pulse current in accordance with display data flows in the organic EL element 14 of each pixel. Further, typical pulse current of the display section 1 is also allowed to flow constantly in the measurement pixel 5. Note that the cathode of the organic EL element 18 is connected to the power source line VSS by the switch 20.

Herein, the pulse current circuit current that is turned on/off by the voltage of VDD-VSS in the case where the voltage is applied for a certain period, but is not a constant current that is turned on/off. Although pulse current calculated from the average value of all pixel data may be given as typical pulse current, the display data of each pixel may be sampled and different values may be given for each frame. For example, pulse current corresponding to the pixel data of a different position in each frame may be given such that a pixel data of the first row on the m-th column is given in the n-th frame and the pixel data of the first row on the (m+1)-th column is given in the (n+1)-th frame.

In performing measurement, another pulse current for measurement purposes is given to the measurement pixel 5, and the controller 7 measures current flowing in the measurement pixel of RGB. In the control of the measurement pixel 5, pulse current intended by the present invention can be given to the organic EL element 18 for measurement purpose by inputting pulse voltage to the control line 12 in the same manner as the case of the display pixel 4.

The cathode of the organic EL element 18 (provided for measurement purposes) is connected to VSS by the switch 20 when performing display as described above, but is connected to the current line 13 when performing measurement. Since the measurement pixels 5 are needed for three colors of RGB, the current of RGB can be measured at once when three systems of the current lines 13 are prepared. However, if the measurement timing of RGB is delayed, and for example, the cathode is connected to the current line 13 of one system on time division in the order of RGB, the current line 13 and a measurement circuit built in to the controller 7 can be formed in one system.

Figure 5:
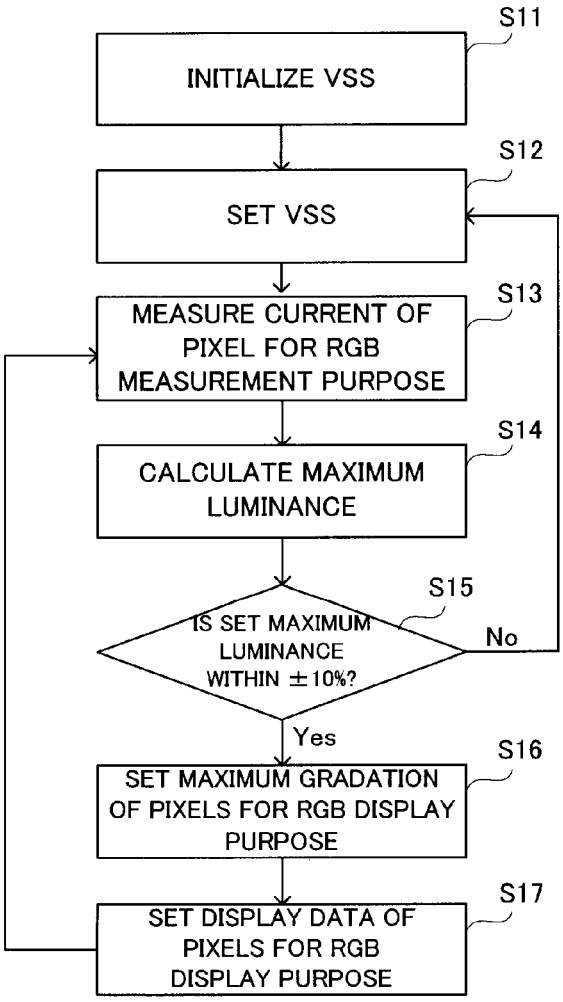
FIG. 5 is a flowchart showing a setting operation of display data.

Further, assuming that the power source voltage VDD is set to a fixed value and VSS is variable, the control flow is as shown in FIG. 5. First, VSS is initialized when a display is turned on (S11), and an initialization value is set to VSS (S12). The current of the measurement pixel is measured on the initial VSS (S13). The maximum luminance that can be output on a predetermined white balance is calculated using the measurement value, color coordinates, and emission efficiency which were previously measured (S14). Determination is made as to whether the calculated value of the obtained maximum luminance falls within ±10% of a set luminance or not (S15). When the value falls within the ±10%, the maximum gradation giving the white balance is set as the maximum gradation of pixels for RGB display purposes (S16), and the display data of the pixels for RGB display purposes is set (S17).

If the value deviates from the ±10% in the determination on S15, processing should return to S12 to set VSS again. For example, VSS is further reduced to increase VDD-VSS in the case of insufficient luminance, or VSS is increased to reduce VDD-VSS when it is too bright. By repeating this operation until the measurement value falls within the set range, predetermined white balance is realized at predetermined luminance.

A target attainment range is set to within 10% in S15 of FIG. 5, but it goes without saying that the value is not limited to 10% and an arbitrary value can be set.

It is preferable for the measurement pixel repeat measurement to be set in a certain period even after the display data has been set. For example, when ambient temperature rises significantly, the measurement value indicates data deviated from the set range, and VSS can be increased to reduce the current in this case.

Furthermore, the typical pulse current of the display section is given to the measurement pixel 5, and the average pixel deterioration of the display section should be reflected. Accordingly, influence by the deterioration is also included in a drive current measured for the measurement pixel 5. Therefore, the control in FIG. 5 simultaneously corrects current variations caused by temperature and deterioration over time.

Moreover, by providing an optical sensor for the measurement pixel 5 and measuring an emission amount for the drive current, the deterioration of emission efficiency can be detected and can also be corrected. In the first place, the emission of the measurement pixel 5 is not necessary because it is not used for display, and there is no problem even if the optical sensor is arranged in the emission region to block emission. On the contrary, the sensor is effective because it can correct the changes of color caused by the different use frequency of RGB, the difference of deterioration characteristics, or the like.

Figure 6A:
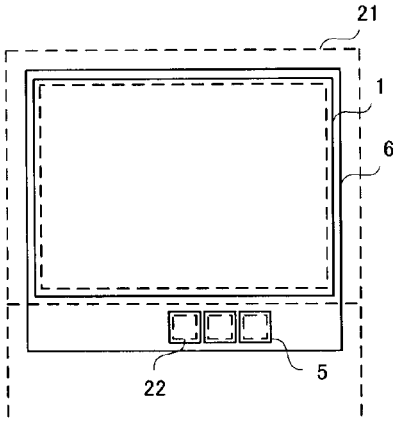
FIGS. 6A and 6B are views showing an arrangement where a luminance sensor is provided for a display device.
Figure 6B:
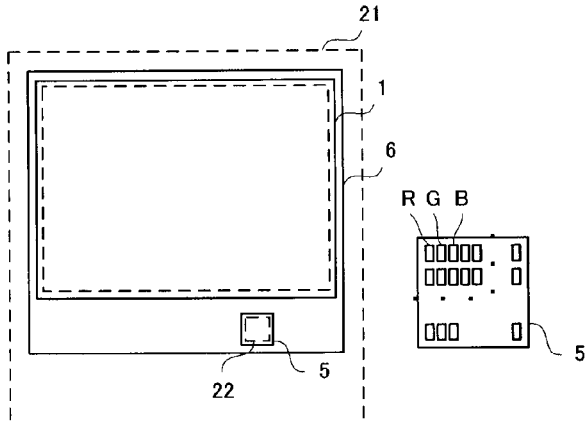

As the optical sensor, an optical (color) sensor, which is formed of a photodiode having sensitivity to RGB, should be used. FIGS. 6A and 6B show the state where an optical sensor 22 is incorporated in a display device. Normally, the display section 1 is exposed from the case 21 of the set, and other areas of the display panel 6 are incorporated behind the case. Herein, FIG. 6A is an example where the optical (color) sensors 22 are severally arranged in the pixels for RGB measurement purposes. Although a sensor having sensitivity to RGB may be used as the optical (color) sensor 22 of FIG. 6A, an optical (color) sensor having sensitivity to R may be used for the pixel for R measurement purposes and optical (color) sensors having sensitivity to G and B may be severally used for the pixels for G and B measurement purposes in the same manner.

Further, the optical (color) sensor 22 having sensitivity to RGB is used, and the measurement pixel is formed in the matrix arrangement of RGB similar to the display pixel 4 and a measurement pixel region may be saved. In this case, the drive transistors 19 of the measurement pixel 5 may be arranged for all the divided measurement pixels as shown in FIG. 6B, the gate terminals of the drive transistors 19 are connected to a common control line 12, or the drive transistor 19 is shared and the organic EL element 18 may be divided in a matrix.

Figure 7:
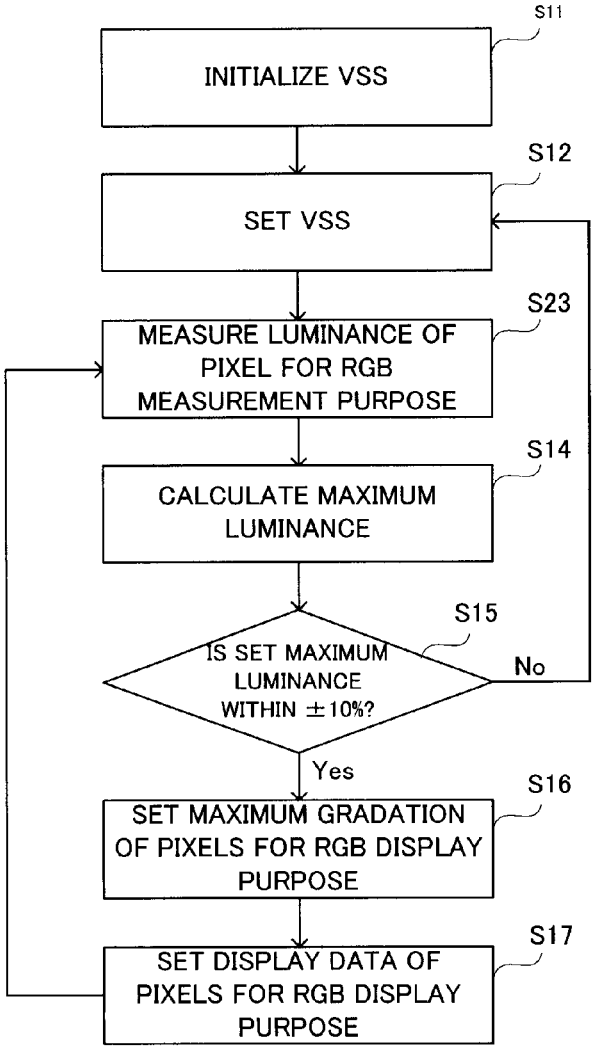
FIG. 7 is a flowchart showing another example of setting operation of display data.

Furthermore, when the luminance of each color can be measured using the optical (color) sensors 22, it is not necessary to measure the current. In short, as shown in FIG. 7, the current measurement in S13 in the control flow in FIG. 5 is replaced with the luminance measurement of each color (S23) by the optical (color) sensors 22. Consequently, it is not necessary to perform conversion from current to luminance in calculating the maximum luminance in S14 because the relationship between the output of the optical (color) sensors 22 and the luminance is known, and correction can be simplified.

Still further, since the reduction of luminance caused by the deterioration of emission efficiency over time is also reflected in the measurement pixel, color shift caused by the different deterioration of the emission efficiency of RGB can also be corrected.

One set of organic EL elements for measurement purposes was provided for each color of RGB as the organic EL element 18 for measurement purposes, but two sets may be provided. When plural sets of measurement pixels 5 are arranged on different positions of the panel and measurement is performed while an emission period is set as short as possible, the temperature distribution of the display panel 6 will be grasped without making the emission of the measurement pixels 5 stand out. In short, it is possible to estimate the temperature difference between the measurement pixels 5 and the display section 1, and more accurate correction can be performed.

Further, when plural sets of measurement pixels 5 are prepared, it is possible to form a plurality of deterioration models by allowing one set to perform the average operation of the pixels of the display section 1 and allowing another set to perform the operation of a pixel, in which the largest amount of current flows, among the pixels of the display section 1. This makes it possible to estimate a range of deterioration level. Consequently, several levels of correction can be selected, and a correction level can be selected depending on a purpose such that correction is performed for the worst case situation, on an average level, or on a middle level between them.

According to the present invention, the display device has the organic EL element for measurement purposes and it is possible to estimate the drive current of the organic EL elements in the display region by detecting the drive state of the organic EL element for measurement purposes. Thus, the display device can maintain appropriate display while compensating temperature variations and degradation over time of the elements.

PARTS LIST

1 display section
2 data driver
3 gate driver
4 display pixels
5 measurement pixel
6 display panel
7 controller
8 data lines
9 gate lines
12 control line
13 current line
14 EL element
15 p-drive transistor
16 selective transistor
17 holding capacitor
18 EL element
19 drive transistor
20 switch
21 case
22 optical sensor

The invention claimed is:

1. A display device comprising:

display emissive elements arranged in a matrix within a display region for emitting light in accordance with a drive current;

a measurement emissive element which is formed in a position different from the display region and formed by the same process as the organic EL elements formed in the display region;

a drive voltage supply circuit for supplying drive voltage to the measurement emissive element;

a drive state detection circuit for detecting a drive state of the measurement emissive element in the case where the drive voltage is supplied by the drive voltage supply circuit; and a correction circuit for correcting voltage to be applied to each display emissive element in the display region based on the drive state detected by the drive state detection circuit;

wherein the drive voltage to be supplied to the display emissive elements in the display region is a specified voltage and the drive of the display emissive elements in the display region is a digital drive where the drive voltage to be supplied to the measurement emissive element is a predetermined voltage and the supply time of the drive voltage is controllable; and the correction circuit changes positive or negative power supply voltage of the display emissive elements in the display region.

2. The display device according to claim 1 wherein:

the drive state detection circuit detects the drive current flowing in the measurement emissive element.

3. The display device according to claim 1 wherein:

the drive state detection circuit detects the emission amount of the measurement emissive element.

4. The display device according to claim 1 wherein:

the drive voltage supply circuit supplies drive voltage, which represents the drive voltage supplied to the display emissive elements in the display region, to the measurement emissive element for measurement purposes.

5. The display device according to claim 4 wherein:

the drive voltage supply circuit supplies typical pulsed voltage, which digitally drives the display emissive elements in the display region, to the measurement emissive element.

6. The display device according to claim 1 wherein:

the drive voltage supply circuit detects the degradation over time of the display emissive elements in the display region based on a detection value of the drive state detect circuit by continuously supplying drive voltage, which is same as the voltage to the display emissive elements in the display region, to the measurement emissive element.

7. The display device according to claim 1 wherein:

the display emissive elements in the display region and the measurement emissive elements have the three colors of red (R), green (G) and blue (B), and the display device comprises a display data set circuit that calculates the maximum luminance of each color of RGB from the drive state of the measurement emissive element of each color of RGB, which is detected by the drive state detect circuit, in the drive state detection circuit and sets display data within a range where the white color is executable.

8. The display device according to claim 1 wherein:

the display emissive elements in the display region and the measurement emissive element are organic EL elements.

9. A method of displaying pixels with a predetermined white balance in a display region emitting light in accordance with a drive current, the display method comprising the steps of:

setting an initialization value of a power source line when a display is turned on;

measuring a current of a plurality of measurement pixels;

calculating a maximum luminance based on the measured current of the measurement pixels;

determining whether calculated value of the maximum luminance is within a targeted range of a set luminance;

resetting the value of the power source line positively if the maximum luminance is greater than the targeted range, and negatively if the maximum luminance is less than the targeted range, and repeating the first four steps above;

setting a maximum gradation of display pixels achieving the predetermined white balance for the display if the calculated value of the maximum luminance is within the targeted range; and setting a display data of display pixels for the display.

10. The method according to claim 9, wherein the targeted range is ±10% of the set luminance.

11. A method of displaying pixels with a predetermined white balance in a display region emitting light in accordance with a luminance emission, the display method comprising the steps of:

setting an initialization value of a power source line when a display is turned on;

measuring the luminance emission of a plurality of measurement pixels;

calculating a maximum luminance based on the measured luminance emission of the measurement pixels;

determining whether calculated value of the maximum luminance is within a targeted range of a set luminance;

resetting the value of the power source line positively if the maximum luminance is greater than the targeted range, and negatively if the maximum luminance is less than the targeted range, and repeating the first four steps above;

setting a maximum gradation of display pixels achieving the predetermined white balance for the display if the calculated value of the maximum luminance is within the targeted range; and setting a display data of display pixels for the display.

12. The method according to claim 11, wherein the targeted range is ±10% of the set luminance.

* * * * *